US008371208B2

(12) United States Patent
Cottle

(10) Patent No.: US 8,371,208 B2
(45) **Date of Patent: *Feb. 12, 2013**

(54) METHOD FOR SHOOTING A SEMI-AUTOMATIC FIREARM

(75) Inventor: Jeremiah Cottle, Moran, TX (US)

(73) Assignee: Slide Fire Solutions LP, Moran, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,535

(22) Filed: Feb. 13, 2012

(65) Prior Publication Data

US 2012/0144994 A1 Jun. 14, 2012

Related U.S. Application Data

(60) Division of application No. 13/281,808, filed on Oct. 26, 2011, now Pat. No. 8,127,658, which is a continuation-in-part of application No. 12/949,002, filed on Nov. 18, 2010.

(60) Provisional application No. 61/262,315, filed on Nov. 18, 2009.

(51) Int. Cl.
*F41A 19/03* (2006.01)

(52) U.S. Cl. ..... 89/140; 89/129.02; 42/69.01

(58) Field of Classification Search ..... 89/127, 89/128, 129.01, 129.02, 140, 136; 42/69.01, 42/75.03, 106

See application file for complete search history.

(56) References Cited

U.S. PATENT DOCUMENTS

| | | | |
|---|---|---|---|
| 554,068 | A | 2/1896 | Kimball |
| 981,210 | A | 1/1911 | Menteyne et al. |
| 1,587,009 | A | 1/1926 | Bobbe |
| 2,220,663 | A | 11/1940 | Rossmanith |
| 2,361,985 | A | 11/1944 | Birkigt |
| 2,465,587 | A | 3/1949 | Sampson et al. |
| 3,031,786 | A | 5/1962 | Robert |
| 3,785,243 | A | 1/1974 | Christakos |
| 4,002,101 | A | 1/1977 | Tellie |
| 4,553,468 | A | 11/1985 | Castellano et al. |
| 4,787,288 | A | 11/1988 | Miller |
| 4,803,910 | A | 2/1989 | Troncoso |
| 5,074,190 | A | 12/1991 | Troncoso |
| 5,092,052 | A | 3/1992 | Godsey |
| 5,780,762 | A | 7/1998 | Kobayashi |
| 5,852,891 | A | 12/1998 | Onishi et al. |
| 5,979,098 | A | 11/1999 | Griggs |
| 6,101,918 | A | 8/2000 | Akins |
| 6,164,002 | A | 12/2000 | Troncoso |
| 6,807,763 | B1 | 10/2004 | Leung |
| 6,966,138 | B1 | 11/2005 | Deckard |
| 7,225,574 | B2 | 6/2007 | Crandall et al. |

(Continued)

OTHER PUBLICATIONS

"[Archived Thread]—My Akins Accelerated 10/22 can kick your 10/22 ass . . . " Purported Internet discussion thread. Aug. 13-22, 2006. (Copyright); Relevant pages may include p. 3 of 5. [http://www.ar15.com/forums/t_6_11/203814_.html].

(Continued)

*Primary Examiner* — Benjamin P Lee

(74) *Attorney, Agent, or Firm* — Endurance Law Group PLC

(57) ABSTRACT

A method for rapidly firing a semi-automatic firing unit having a trigger, a receiver and a barrel. The firing unit is placed in a handle so as to enable only reciprocating linear movement along a constrained linear path that is parallel to the barrel. The user grasps the handle and places their trigger finger firmly on a finger rest. In use, the user generates a forward activation force that urges the firing unit forwardly so that the trigger collides with the stabilized finger, stimulating the first round of ammunition in the receiver. A recoil force from the discharging ammunition pushes the firing unit rearwardly so that the trigger separates from the stabilized finger. During the recoil event, the user may apply negative resistance to the translating firing unit which may be varied by the user on-the-fly to proportionally change the firing tempo.

19 Claims, 10 Drawing Sheets

U.S. PATENT DOCUMENTS

| | | | |
|---|---|---|---|
| 7,273,002 | B1 | 9/2007 | Rogers |
| 7,340,857 | B1 | 3/2008 | Bentley |
| 7,398,723 | B1 | 7/2008 | Blakely |
| 7,562,614 | B2 | 7/2009 | Polston |
| 7,596,900 | B2 | 10/2009 | Robinson et al. |
| 8,051,593 | B2 | 11/2011 | Vesligaj |
| 2005/0183312 | A1 | 8/2005 | Speaks |
| 2006/0123683 | A1 | 6/2006 | Garrett et al. |
| 2010/0071246 | A1 | 3/2010 | Vesligaj |
| 2012/0042556 | A1 | 2/2012 | Vesligaj |

OTHER PUBLICATIONS

"Akins Accelerator Decision v 2.0"; Purported internet discussion thread. Jan. 9-Jun. 30, 2007. [http://thefiringline.com/forums/archive/index.php?t-234087.html].

"Another neutered Akins accelerator FS"; Purported internet discussion thread. Jan. 19-30, 2009. [http://1919a4.com/showthread.php?21872-Another-neutered-Akins-accelerator-FS].

"ATF reverses decision . . . "; Purported internet discussion thread. Dec. 6-24, 2006. [http://www.thehighroad.org/archive/index.php/t-240357.html].

"Bill_Akins > albums > Private concepts"; Purported video posted to internet. Oct. 16, 2008. [http://good-times.webshots.com/video/3011228380099763970axOjzH].

"Just Wanted to Show Off My Bumpfiring Toy"; Purported internet discussion thread with embedded videos. Nov. 13, 2008-May 14, 2010; Relevant pages may include p. 1 of 2. [http://forum.saiga-12.com/index.php?/topic/31610-just-wanted-to-show-off-my-bumpfiring-toy-p/].

"More Thoughts on the Akins Accelerator"; Purported Internet discussion thread. May 29, 2008-Sep. 25, 2009. [http://armsandthelaw.com/archives/2008/05/atkins_accelera.php].

"Screw the ATF and 1022"; Purported internet discussion thread. Apr. 10-11, 2007. [http://www.thehighroad.org/archive/index.php/t-268573.html].

"Turn in Your Killer Springs Here"; Purported internet discussion thread. Jan. 9-10, 2007. [http://www.thehighroad.org/archive/index.php/t-246764.html].

Michael Foeller II letter from US US Department of Justice, Bureau of Alcohol, Tobacco, Firearms and Explosives, Jun. 18, 2008.

Michael Johnson letter from US Department of Justice, Bureau of Alcohol, Tobacco, Firearms and Explosives, Jun. 26, 2008.

FIG. 7
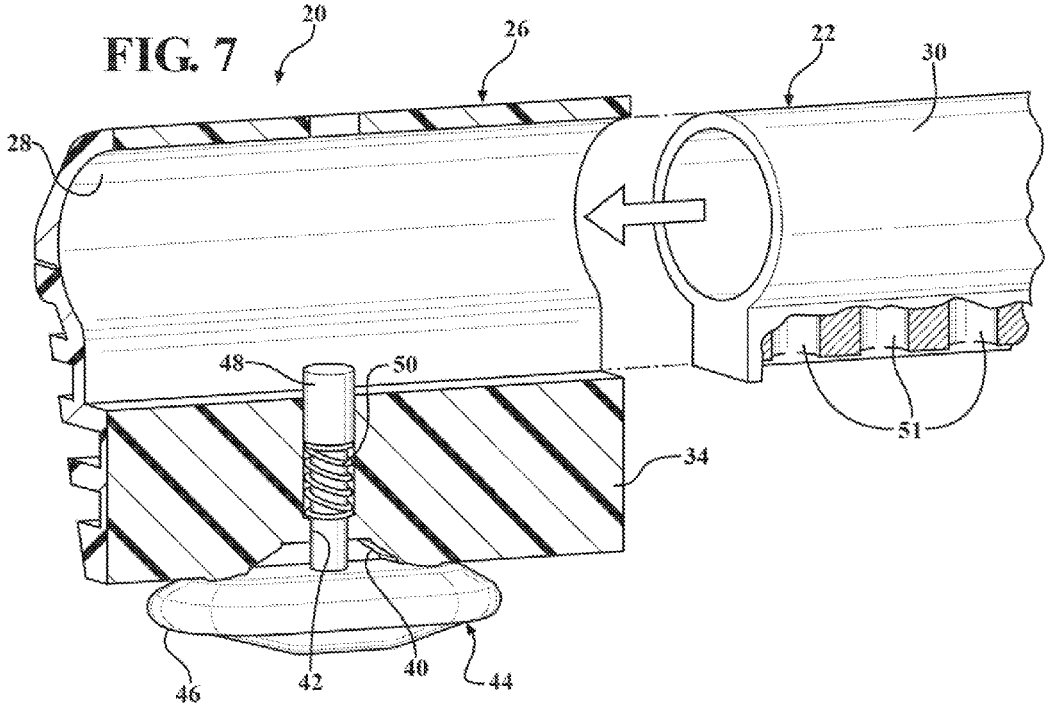
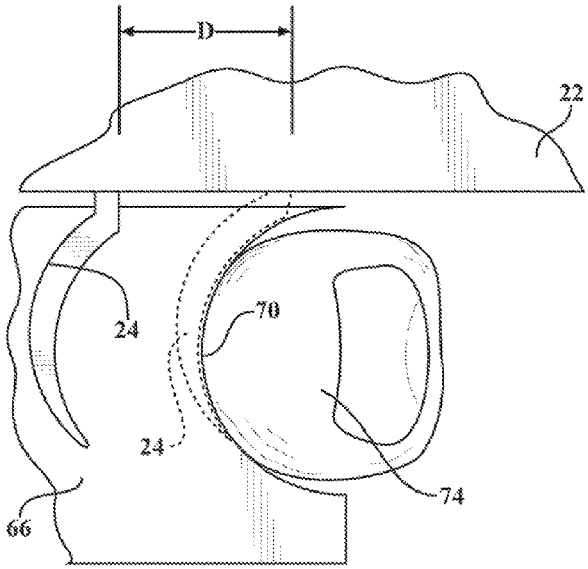
FIG. 8

METHOD FOR SHOOTING A SEMI-AUTOMATIC FIREARM

CROSS REFERENCE TO RELATED APPLICATIONS

This application is a Divisional of U.S. Ser. No. 13/281,808, filed Oct. 26, 2011, which is a Continuation-In-Part of U.S. Ser. No. 12/949,002, filed Nov. 18, 2010, which claims the benefit of U.S. Provisional Application Ser. No. 61/262,315 filed Nov. 18, 2009.

BACKGROUND

1. Field of the Invention

The present invention relates generally to a method for shooting firearms, and more particularly toward a method for sequentially firing rounds of ammunition from a semi-automatic firearm utilizing human muscle power to discharge each round while controlling the aim of the firearm.

2. Related Art

Various techniques and devices have been developed to increase the firing rate of semi-automatic firearms. Many of these techniques and devices make use of the concept known as "bump firing", which is the manipulation of the recoil of the firearm to rapidly activate the trigger. One such bump firing technique is known as the "belt loop" method. To execute the belt loop method, the operator first places the firearm next to his or her hip and hooks one finger through both the trigger mechanism and a belt loop in the his or her clothing. The opposite hand is placed on the hand guard, which is attached to the barrel of the firearm. When the firearm is pushed forward by the operator, the trigger is activated by the finger to discharge a bullet. The recoil from the bullet pushes the firearm backwards away from the trigger finger, allowing the trigger to re-set. Forward force must be applied to the hand guard in order to activate the firing mechanism for each round that is fired. However, this may be achieved in very rapid succession.

Although able to achieve a high rate of firing, the belt loop has many safety and accuracy issues. For example, to correctly operate many firearms with the belt loop method, the operator's arm must be placed in the path of hot gasses being expelled from the ejection port of the firearm. This could lead to skin burns or possibly pinch the operator's sleeve or skin in the action. Another issue with the belt loop method arises because the operator cannot have a firm grip on the stock or the pistol grip of the firearm. Because the belt loop method only works if the firearm is held loosely with one hand, and the chances of the operator losing control of the firearm are greatly amplified. Because of this unnatural and unbalanced firing grip, the firearm is very difficult to aim and control during the belt loop method.

Commercial devices are also available for assisting in the bump firing concept, including the HELLSTORM 2000 and TAC Trigger. Both of these are small devices that mount to the trigger guard of the firearm and use springs to aid in quickly resetting the trigger while the firearm is bump fired, as described above. However, the same safety and accuracy issues of the belt loop method apply to these devices because the firearm cannot be held securely with the trigger hand or the stock of the firearm.

Another device for increasing the firing rate of a semi-automatic firearm is shown in U.S. Pat. No. 6,101,918, issued to Akins on Aug. 15, 2000 ("Akins '918"). Akins '918 shows a handle for rapidly firing a semi-automatic firearm having a trigger. The handle of Akins '918 extends from the stock all the way to the barrel of the firearm and a spring rod guide system supports the receiver and barrel of the firearm for longitudinal movement of the firearm relative to the handle. The handle includes a grip portion for holding the firearm. Springs are disposed between the handle and the firearm for continuously biasing the firearm in a forward direction. The handle further includes a finger rest against which the shooter's trigger finger stops after the trigger is initially pulled. In operation, the operator places their trigger finger (typically an index finger) against a trigger and gently squeezes or pulls the trigger rearwardly to discharge a first bullet. The recoil of the firearm forces the receiver and trigger mechanism longitudinally backward relative to the handle at the same time the shooter's trigger finger lands in a stationary position against the rest. The springs are carefully sized to the ammunition so as to be easily overcome by the recoil energy of a fired bullet. Continued rearward movement of the receiver and trigger assembly under the influence of recoil creates a physical separation between the shooter's finger (now immobilized by the rest) and the trigger, thus allowing the trigger mechanism of the firearm to automatically reset. As the recoil energy subsides, the constant biasing force of the springs eventually becomes sufficient to return the receiver and trigger portions of the firearm back to the starting position without any assistance from the operator. In the meantime, if the operator's trigger finger remains immobilized while the springs push the firearm back to its starting position, the reset trigger will collide with the finger and automatically cause the firearm to discharge another round, thus repeating the firing cycle described above. So long as the shooter's finger remains in place against the rest and there is an ample supply of fresh ammunition, the firearm will continue firing rapid successive rounds without any additional human interaction or effort. One significant drawback of the Akins '918 construction is that automatic mechanisms of this type have been scrutinized for violating federal firearms laws. Another drawback is that different spring sizes (i.e., different resistance characteristics) may be required from one unit to the next depending on the type of ammunition used so that the springs do not overpower the recoil energy. This of course introduces inventory complexities.

A still further example of non-conventional shooting methods may be found by reference to U.S. Pat. No. 7,225,574 to Crandall et al., issued Jun. 5, 2007. In this case, which is not intended for semi-automatic type firearms, a shooter's muscle power is used to shuttle portions of a firing unit back and forth much like a traditional pump-action shotgun. A trigger mechanism is configured to be stimulated on the rearward pull-stroke, causing the ammunition to discharge. The forward push-stroke results in ejection of the spent shell casing. One particular disadvantage of this arrangement is that the natural recoil force generated by the discharge event is compounded by the shooter's pull-stroke. This may have a disadvantageous effect on aiming accuracy, particularly in rapid, multi-round volley shooting scenarios. It will therefore be appreciated that the shooting method of Crandall et al. is not conducive to rapid fire shooting as is common with semi-automatic firearms.

There exists a continuing need for further improvements in devices allow the operator to practice new and interesting ways to shoot firearms in a legal and safe manner, to increase the firing rate of semi-automatic firearms without compromising the safety of the operator or the accuracy of the firearm, which are generally universally functional without respect to ammunition type, and which are sufficiently distinguished from a fully automatic weapon so as to fall within compliance of federal firearms regulations.

SUMMARY OF THE INVENTION AND ADVANTAGES

According to one aspect of the invention, a method is provided for firing multiple rounds of ammunition in rapid succession from a semi-automatic firearm. A semi-automatic receiver is provided for chambering a round of ammunition. A barrel extends forwardly from the receiver and a trigger configured to selectively stimulate a round of ammunition disposed in the receiver. The receiver and barrel and trigger are moveable together as a firing unit. A first round of ammunition is loaded into the receiver. An actuator is stabilized in a stationary position so that the firearm trigger will intermittently collide with the actuator in response to linear reciprocating movement of the firing unit. The firing unit is slideably supported for linear reciprocating movement relative to the stabilized actuator during said moving and said removing steps. The linear reciprocating movement occurring along a constrained linear path that is generally parallel to the firearm barrel. A primary forward activation force is generated that urges the firing unit forwardly so that the trigger collides a first time with the stabilized actuator. This, in turn, stimulates the first round of ammunition in the receiver and causes at least a portion of the first round of ammunition to be discharged from the receiver into the barrel. The discharging step includes generating a recoil force sufficient to cause the firing unit to translate rearwardly relative to the stabilized actuator. The trigger separates from the actuator in direct response to the recoil force. A second round of ammunition is auto-loaded into the receiver in response to the recoil force. A secondary forward activation force is then generated that urges the firing unit forwardly relative to the stabilized actuator so that the trigger collides a second time with the stabilized actuator. The stimulating step is then repeated with respect to the second round of ammunition in the receiver. According to this aspect, the improvement comprises varying the intensity of the secondary forward activation force relative to the primary forward activation force to proportionally alter the firing tempo of the semi-automatic firearm.

The subject invention allows the operator to maintain a stable firing form and grip while rapidly re-firing their semi-automatic firearm with little to no loss in accuracy. In contrast to many prior art rapid-firing techniques, an operator practicing the subject method must manually push the firearm forward relative to the handle to activate the trigger following each recoil event. Therefore, each discharge event of the firearm is under the uninterrupted control of the operator's human muscle power. The present invention enables a new and exciting rhythmic shooting style that will add enjoyment and excitement to the sport of shooting firearms. The subject invention can be designed for use with a wide range of semi-automatic firearm types, including both rifle and pistol styles, and can be practiced with any semi-automatic substantially without respect to ammunition type.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 7 is a side view of the first exemplary embodiment of the lock;

FIG. 8 is a side view of the trigger guard and a trigger;

FIGS. 11A and 11B show time sequence views of the same user holding a firing unit that is slideably supported in a handle according to another embodiment of this invention, the firing unit shown in a rearward configuration in. FIG. 11A allowing the trigger to reset and in a forward configuration in FIG. 11B in which a round of ammunition is discharged according to the firing method of this invention;

DETAILED DESCRIPTION OF THE INVENTION

Figure 1:
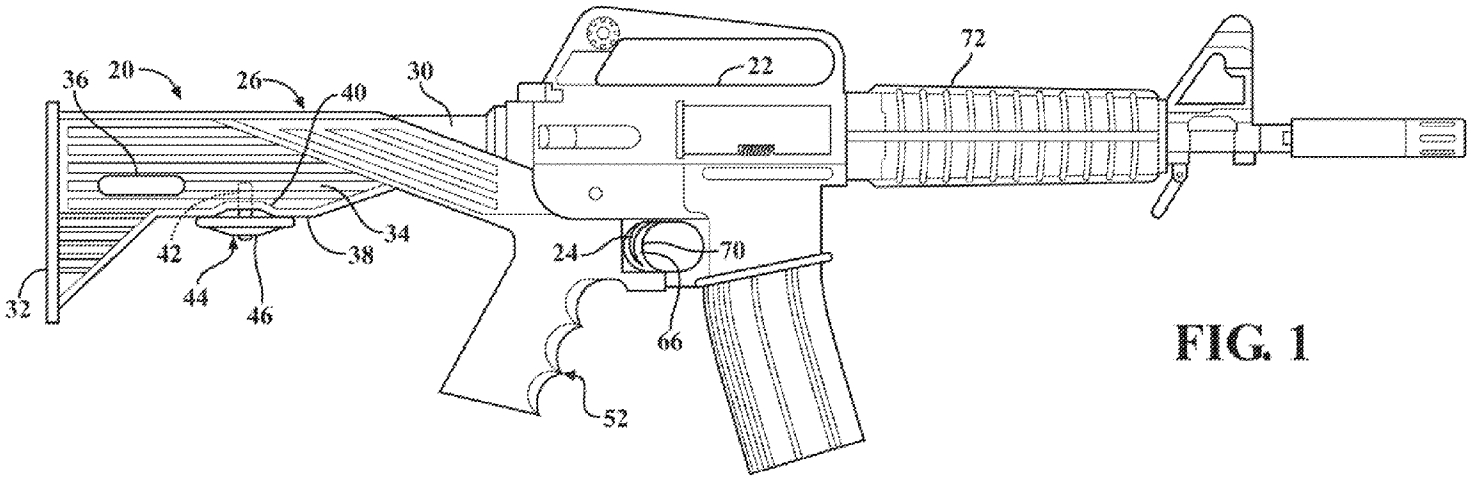
FIG. 1 is a left side view of the first exemplary embodiment of the handle supporting an AR-15 firing unit.

Referring to the Figures, wherein like numerals indicate like or corresponding parts throughout the several views, a serviceable firearm is shown comprising a handle 20 supported in a firing unit 22. The firing unit 22 includes a receiver 21 for chambering a round of ammunition, a barrel 23 extending forwardly from the receiver 21, and a trigger group 24 configured to selectively stimulate a round of ammunition disposed in the receiver 21. The firing unit 22 may also include additional features as will be readily understood by those of skill in the art and also as described in some details further below. The receiver 21 and barrel 23 and trigger 24 are moveable together as a firing unit 22. The handle 20 supports the firing unit 22 in use for aiming and shooting.

Figure 2:
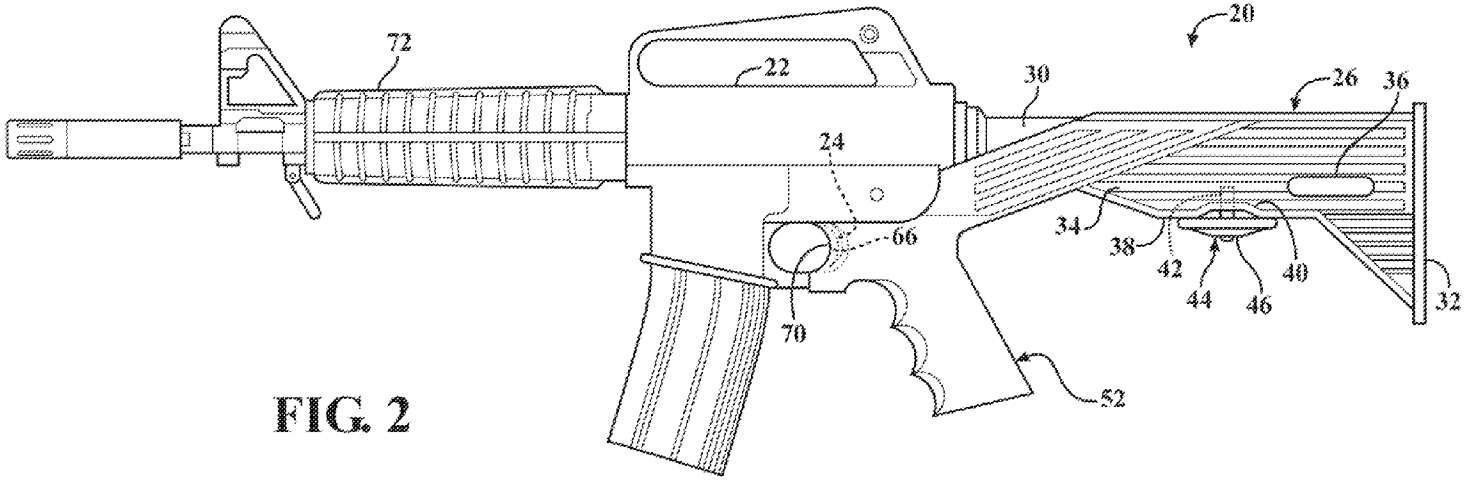
FIG. 2 is a right side view of the first exemplary embodiment of the handle supporting an AR-15 firing unit.
Figure 3:
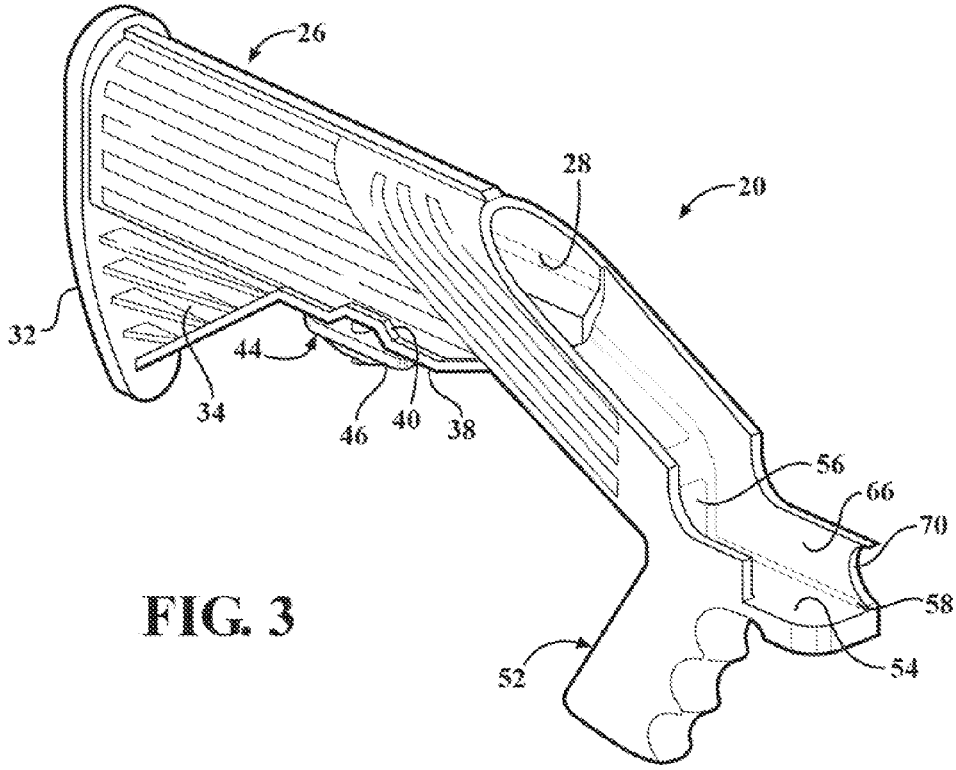
FIG. 3 is a perspective view of the first exemplary embodiment of the handle with the lock in a locked position.
Figure 10:
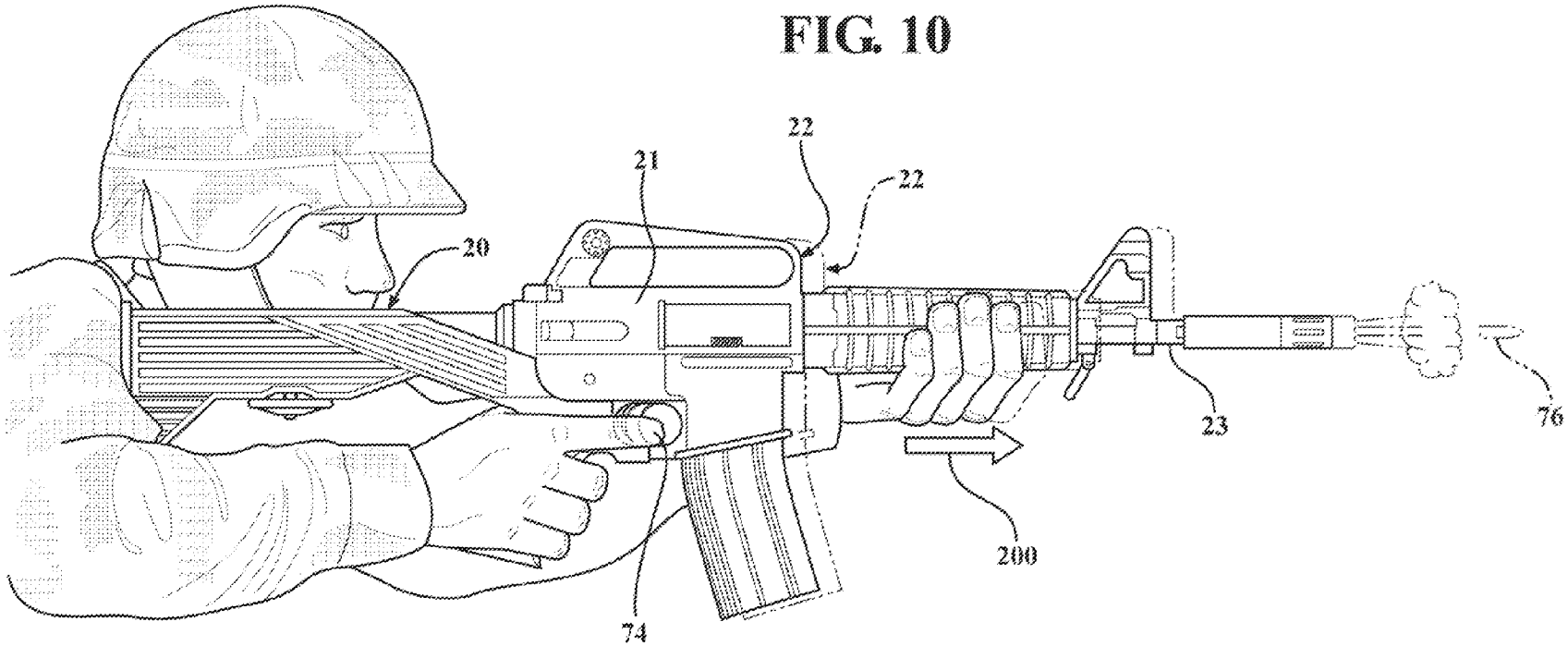
FIG. 10 shows a user holding a firing unit that is slideably supported in a handle according to one embodiment of this invention, with the firing unit shown in phantom advanced forwardly to discharge a round of ammunition according to the firing method of this invention.
Figure 11A:
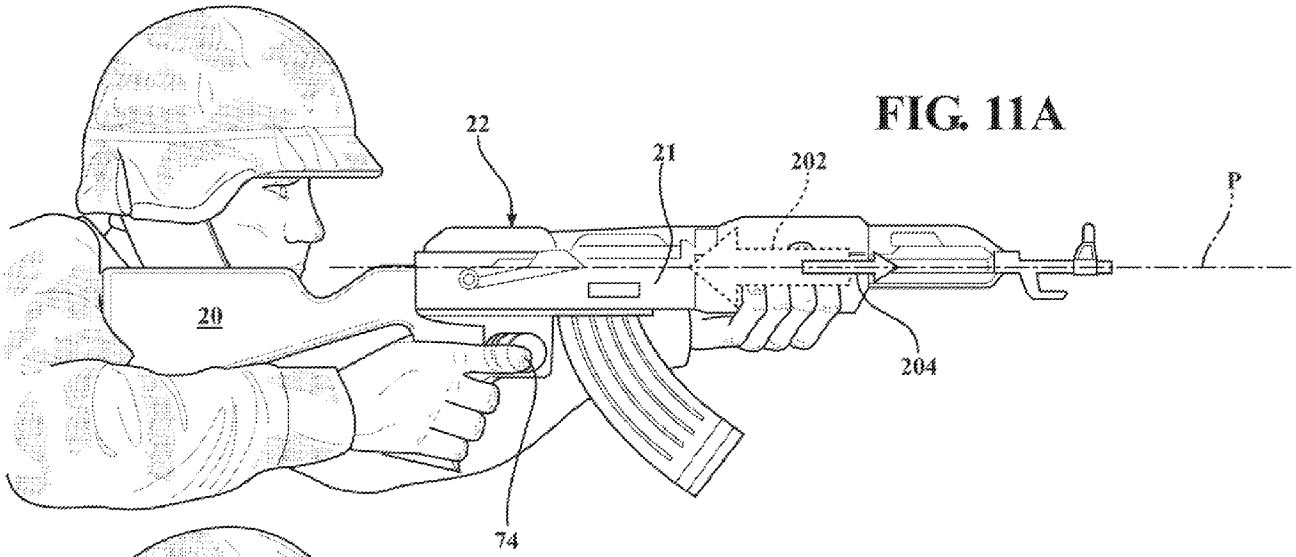
Figure 11B:
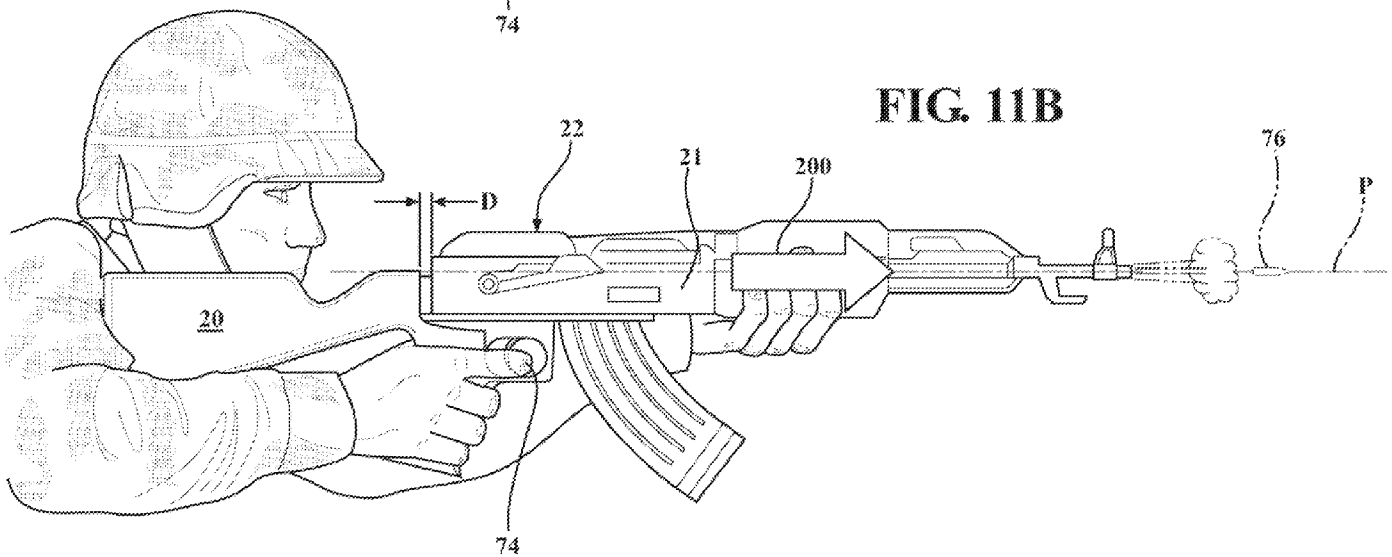

The handle 20 is shown in FIGS. 1, 2 and 10 configured for attachment to an AR-15 type semi-automatic firing unit 22. For contrast, FIGS. 11A and 11B show the handle 20 configured for attachment to an AK-47 type semi-automatic firing unit 22. Gunsmiths and others of skill in this art will appreciate that, with minor modifications, the handle 20 can be readily adapted to any suitable semi-automatic firing unit 22 such as the AR-10, SKS, FN-FAL, Mini 14, MAC-11, TEC-22, HK-91, HK-93, M1-A, K-1, K-2, and Ruger 10-22 devices to name but a few. According to one embodiment of this invention, the handle 20 includes a shoulder stock 26 configured to be pressed firmly into the shoulder of a user, as shown for example in FIGS. 10, 11A and 11B. A buffer cavity 28 is formed inside the shoulder stock 26 (in at least the AR-15 models) for slidably receiving a buffer tube 30 of the semi-automatic firing unit 22. Of course, the shape of the buffer cavity 28 will be modified or eliminated entirely to accommodate the particular type of semi-automatic firing unit 22 used. One end of the shoulder stock 26 of the handle 20 presents a bat end 32 for pressing into the shoulder of an operator when the firing unit 22 is raised to a firing position. The shoulder stock 26 may include ribs and webs 34 surrounding the buffer cavity 28 to establish a structurally supporting network. Alternatively, as suggested in FIGS. 11A and 11B, the shoulder stock 26 may take the form of a shell or monolithic structure. To a large extent, the aesthetic appearance of the shoulder stock 26 is subject to a wide range of expressions. A sling attachment slot 36 may be integrated into the should stock 26 for attaching one end a sling (not shown). The other end of the sling may be attached to any suitable location including, for example, to a ring (not shown) disposed between the buffer tube 30 and the receiver 23 or a swivel clasp anchored adjacent the barrel 23.

The shoulder stock 26 includes a undersurface 38 which, in this particular example, extends forward from the butt end 32 toward the receiver 21. The undersurface 38 may be formed with a recessed portion 40. A bore 42 extends vertically from the recessed portion 40, through the vertical rib 34, and into the buffer cavity 28. In models that do not utilize a buffer cavity 28, the bore 42 may either extend into a hollow space or be configured as a blind hole stopping inside the material of the shoulder stock 26.

Figure 4:
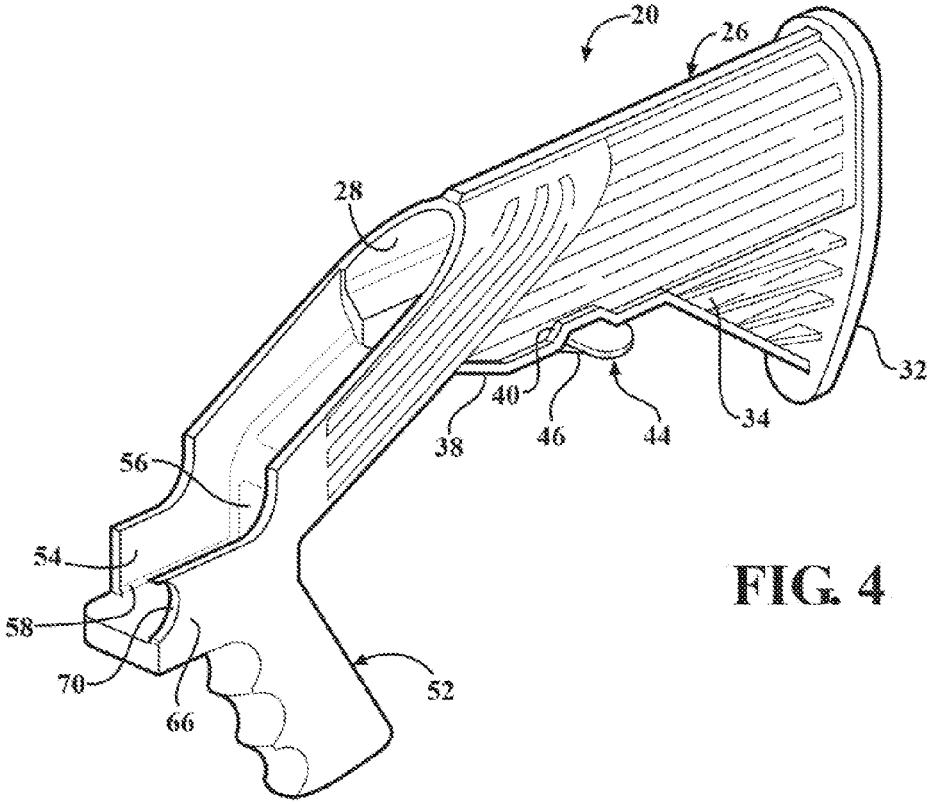
FIG. 4 is a perspective view of the first exemplary embodiment of the handle with the lock in an open position.

A lock 44 interacts with the recessed portion 40 and the bore 42 so as to allow a user to selectively switch operation of the firearm between traditional semi-automatic shooting modes and rapid firing modes, wherein rapid firing mode is accomplished using the novel methods of this invention. The lock 44 has an open position (shown in FIGS. 1-3 and 7) in which the firing unit 22 may operate in a rapid fire mode, and a locked position (FIG. 4) in which the firing unit 22 is constrained to traditional or standard fire of operation. In the open position, the lock 44 allows longitudinal movement of the firing unit 22 relative to the shoulder stock 26. The longitudinal direction is here defined as generally parallel to the long axis of the barrel 23. In contrast, in the locked position the handle 20 is longitudinally locked to the firing unit 22 to prevent sliding movement of the firing unit 22 relative to the shoulder stock 26. The lock 44 of the first exemplary embodiment includes a cam 46 with a pin 48 extending perpendicularly away from the cam 46 into the bore 42 of the shoulder stock 26. As best shown in FIG. 7, the lock 44 also includes a spring 50 for biasing the cam 46 against the undersurface 38 of the shoulder stock 26. The pin 48 and the spring 50 are preferably made of metal, but other materials may also be used. Of course, the lock 44 may be redesigned to mount in alternative ways. In the open position, the cam 46 extends parallel to the undersurface 38 and covers the recessed portion 40 of the undersurface 38 to vertically space the pin 48 from the buffer tube 30 of the firing unit 22. In other words, the cam 46 is turned such that interaction with the undersurface 38 forces a gap between the cam 46 and the recessed portion 40 of the undersurface 38. In the locked position, the cam 46 is turned perpendicularly relative to the undersurface 38, and the cam 46 is nestled into the recessed portion 40. This, in turn, causes the pin 48 to move vertically upwardly to engage a hole or detent 51 in the buffer tube 30 of the firing unit 22 and thereby prevent longitudinal movement of the firing unit 22 relative to the handle 20. It will be understood by those of skill in the art that buffer tubes 30 for military spec. AR-15 type rifles commonly include a row of holes or detents 51 for aligning with the length of the shoulder stock portion of a prior art firing unit. The lock 44 provides the operator with an extremely simple and quick way to switch between the rapid fire mode and the standard fire mode. Naturally, the particular design of the lock 44 illustrated in the Figures is but one of many possible expressions with which to accomplish the lock-out function. Indeed, other rifle types may require some other strategy by which to mount the lock 44 so that a user may selectively switch operation of the firearm between traditional semi-automatic shooting mode and rapid firing mode.

The first exemplary embodiment of the handle 20 further includes a grip portion, generally indicated 52, connected to the shoulder stock 26. The grip portion 52 extends downwardly and slightly angularly rearwardly in an ergonomically suitable position common with many military and sporting rifle designs. It should be appreciated that the grip portion 52 of the handle 20 could take many different forms. For example, in an alternative embodiment, the grip portion 52 could take the shape of the neck-like region of the shoulder stock 26 just behind the trigger 24 of the firing unit 22, as is typical in many hunting rifles.

Some portion of the handle 20 is configured as a sliding interface 54 with the firing unit 22. The sliding interface 54, wherever created relative to the handle 20 and firing unit 22, establishes a constrained linear path P generally parallel to the firearm barrel 23. The constrained linear P is highlighted in FIGS. 11A and 11B. In the AR-15 model shown in several of the Figures, the sliding interface 54 takes the form of an inverted "T" shaped channel having an open front and a closed back 56 with a pair of opposing grooves 58, in combination with the buffer cavity 28. In other model types, however, the sliding interface 54 may be configured very differently. For example, since an AK-47 does not have a buffer tube, the sliding interface 54 for an AK-47 type firing unit 22 as in FIGS. 11A and 11B may be formed in an altogether different manner.

Figure 5:
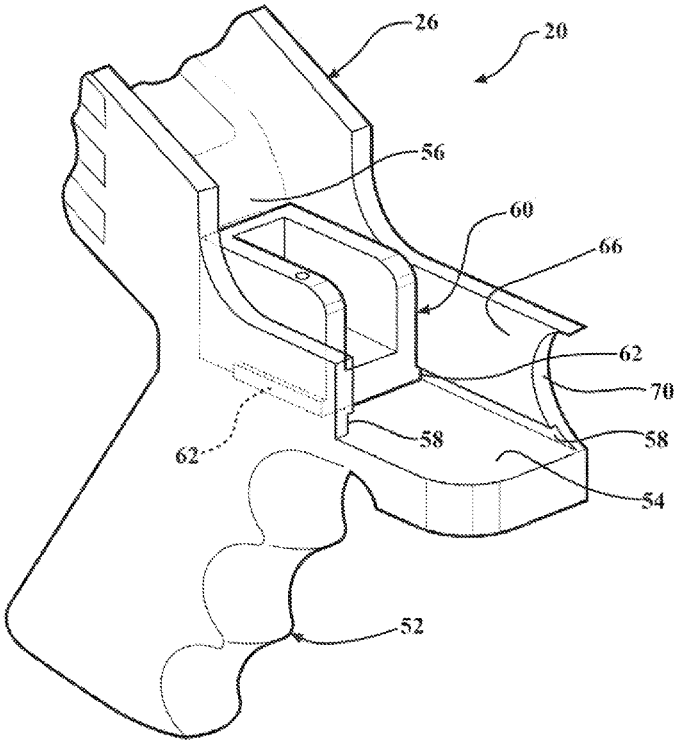
FIG. 5 is a front perspective view of the bearing element according to one embodiment of the invention.
Figure 6:
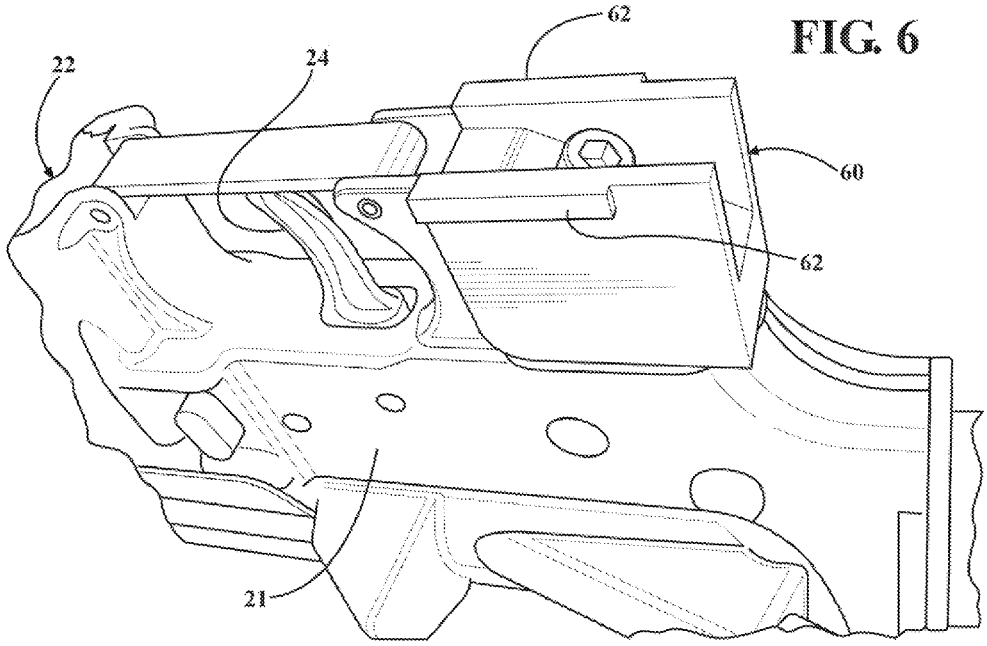
FIG. 6 is a rear perspective view of the bearing element of FIG. 5.

At least one bearing element 60 is attached to or part of the firing unit 22 so that the bearing element 60 moves longitudinally back and forth with the firing unit 22. In one embodiment designed specifically for AR-15 rifles, the bearing element 60 may take the form of a block-like member like that shown in FIGS. 5 and 6 in functional cooperation with the original equipment buffer tube 30. For the AR-15 model, the block-like bearing element 60 is affixed behind the trigger 24 assembly of the firing unit 22 in the location, and using the same anchoring socket, that previously secured the Original Equipment pistol grip. As shown in FIG. 6, an aperture 64 receives a screw to engage a threaded hole the firing unit 22. In other rifle model types, however the shape of the bearing element 60, as well as its attachment points and methods may be different. And, so exemplified already by the use of the OE buffer tube 30 as part of the sliding interface system, a pre-existing portion of the firing unit 22 may be utilized and/or re-purposed to provide a constraining effect on the movement of the firing unit 22 within the handle 20 so that relative linear motion therebetween occurs only along the path P. The block-like bearing element 60 of FIGS. 5 and 6 is slidably disposed in the inverted "T" shaped channel portion of the sliding interface 54. The block-like bearing element 60 includes a pair of opposing ridges 62 adapted to register in the grooves 58 of the "T" shaped channel to constrain the movement of the firing unit 22 within the handle 20 to linear motion only along the path P.

When the lock 44 is in the locked position with the pin 48 engaging the detent 51 or hole in the buffer tube 30, the buffer tube 30 is locked relative to the buffer cavity 28 and the interconnected bearing element 60 and firing unit 22 cannot slide in the sliding interface 54. However, when the lock 44 is in the open position, the buffer tube 30 is free to slide in the buffer cavity 28 and the bearing element 60 is free to slide in the sliding interface 54. Thus, when the lock 44 is in the open position, the firing unit 22 is free to move longitudinally relative to the handle 20. When the firing unit 22 is operated in the rapid fire mode, the bearing element(s) 60 acts as a bearing or a bushing, to facilitate the longitudinal movement of the firing unit 22 relative to the handle 20 along the confined linear path P.

The handle 20 further includes a trigger guard 66 extending longitudinally forward from the grip portion 52 for disposition on one side of the trigger 24 of the firing unit 22. The trigger guard 66 extends longitudinally forward of the trigger 24 to an open end that forms a finger rest 70 for stabilizing an actuator 74, such as a finger or other stationary object. The actuator 74 is the element used to make direct contact with the trigger 24. Alternatively to the operator's finger, a cross-pin or any other comparable object could be used as the actuator 74 and placed at or near the finger rest 70 in a position to intermittently make contact with the trigger 24. Thus, for handicapped users without the use of a suitable trigger finger, a cross pin affixed at or near the rest 70 may serve as the actuator 74 instead of a human finger. When the actuator 74 is stabilized with respect to the rest 70, the trigger 24 will intermittently collide with the actuator 74 in response to linear reciprocating movement of the firing unit 22, and in particular after the firing unit 22 has been moved longitudinally forward by a predetermined distance D relative to the handle 20. The predetermined distance D is at least equal to, but more preferably greater than, the separation distance between actuator 74 and trigger 24 that is needed to fully reset the trigger 24 so that the firing unit 22 can be fired again. This trigger 24 resting phenomenon is a function of the mechanical design of the trigger group assembly, the springs used therein, parts wear, lubrication qualities, etc. In most cases, the distance D may be established at about one inch (1") of travel. The relative sliding distance between the bearing element 60 and the sliding interface 54 is thus generally equal to the predetermined distance D, which in turn may be several times longer than the actual minimum separation distance needed to rest the trigger 24. In this way, the trigger 24 is reasonably assured to rest at some point while the firing unit 22 separates from the handle 20 along the travel distance D.

The trigger guard 66 may be disposed on both sides of the trigger 24 providing something resembling a stall or chute for the trigger 24 to slide back and forth in. However, for ease of access the trigger guard 66 may be shortened on one side so that the trigger 24 can be accessed on the side of the firing unit 22 for firing the firing unit 22 in the standard firing mode, as will be discussed in greater detail below. In this manner, the trigger guard 66 restricts or otherwise impedes access to the trigger 24, but in the preferred embodiment does not prevent access altogether. That is to say, the shooter can choose to remove their finger from the rest 70 and access the trigger 24 in the traditional manner, preferably in conjunction with locking out the sliding functionality via the lock 44. The shoulder stock 26, grip portion 52, and trigger guard 66 are preferably made as a monolithic unit of a glass filled nylon, a polymer filled nylon, carbon fiber, metal, or any other material strong enough to withstand repeated discharges of the gun over time. Injection molding is the preferred manufacturing process of the handle 20, but casting, machining, or any other manufacturing process may also be employed depending, at least in part, on the specific material used.

Installation of the first exemplary embodiment of the handle 20 is very simple. On AR based rifles 22, like the one shown in the handle 20 of FIGS. 1 and 2, the manufacturer's shoulder stock is first removed from the buffer tube 30. Next, the manufacturer's pistol grip is removed using an Allen wrench or other suitable tool. The bearing element 60 is then mounted onto the firing unit 22 where the pistol grip was previously mounted with a screw, bolt, stud, or any other suitable fastener placed through the aperture 64. Of course, the shape of the bearing element 60 may take many different forms and its particular mounting arrangement altered to suit different types of firing units 22. The bearing element 60 may even be selected from some pre-existing portion, i.e., a factory installed feature, of the firing unit 22 such as the buffer tube 30 as but one example. Once the bearing element 60 has been mounted onto the firing unit 22, the buffer tube 30 of the firing unit 22 is slid into the buffer cavity 28 of the shoulder stock 26 of the handle 20. Simultaneously, the ridges 62 of the bearing element 60 are guided into the grooves 58 of the sliding interface 54 to slidably support the firing unit 22 within the handle 20. The lock 44 may now be rotated to the position shown in FIG. 3 to put the firing unit 22 in the standard fire mode or the lock 44 to the position shown in FIG. 4 to put the firing unit 22 in the rapid fire mode.

Although the first embodiment of the handle 20 is shown mated with an AR-15 firing unit 22, it must be appreciated that with minor geometrical changes, the handle 20 may be mounted to other types of semi-automatic firing units, including both rifles and pistols.

Turning now to FIGS. 10-14, a method for firing multiple rounds of ammunition in succession from a semi-automatic firearm according to the novel shooting methods of this invention will be described in greater detail. A human user is provided having first and second body parts. For most users, the first and second body parts will comprise left and right hands. However, the shooting method can be adapted for use in non-standard ways that may required the first and second body parts to be identified as other parts of the human body. In any event, it is intended that the first body part is moveable relative to the second body part, and that the user is capable of creating controlled muscle forces in response to movement of the first body part. That is, the user is in control of their first body part (e.g., left hand) to a degree required for safe operation of a firearm.

Once a first round of ammunition is loaded into the receiver 21, the user's first body part (e.g., left hand) is placed in operative relationship with the firing unit 22 (e.g., gripping a hand guard 72 under the barrel 23) so that movement of the first body part causes a corresponding movement in the firing unit 22. The actuator 74 (e.g., a right hand index finger) is then stabilized in a stationary position relative to the user's second body part (e.g., right hand) so that the firearm trigger 24 will intermittently collide with the actuator 74 in response to linear reciprocating movement of the firing unit 22. Next, the user's first body part (e.g., left hand) is moved relative to the second body part (e.g., right hand) using human muscle power to generate a primary forward activation force 200 (see FIG. 11A) that urges the firing unit 22 forwardly so that the trigger 24 collides a first time with the stabilized actuator 74. Contact with the trigger 24 stimulates the first round of ammunition loaded in the receiver 21. That is to say, as a direct response to the step of moving the first body part relative to the second body part, the live round of ammunition is activated in the chamber of the receiver 21. Naturally, this stimulating step results in discharging at least a portion of the first round of ammunition (e.g., the bullet 76 or projectile portion of the ammunition round) from the receiver 21 into the barrel 23, typically leaving a spent shell casing in the receiver 21. A recoil force 202 (see FIG. 11B) is thus generated of sufficient strength to cause the firing unit 22 to translate rearwardly relative to the stabilized actuator 74. This has the immediate effect of separating the trigger 24 from the actuator 74. The total rearward distance the firing unit 22 may travel relative to the handle 20 is the predetermined distance D, and the recoil force 202 is so great that the short distance D is traversed in a small fraction of a second. At some point while the firing unit 22 is in rearward motion as a result of the recoil event, the spent shell casing of the first round is ejected and a second round of ammunition is automatically self-loaded into the receiver 21. This automated ejection and self-loading step is characteristic of a semi-automatic firearm, which typically exploits gas pressures scavenged from the expanding gunpowder of a discharging round of ammunition. After the firing unit 22 has traveled rearwardly relative to the handle 20 by the predetermined distance D, the user's first body part (e.g., left hand) is re-moved using human muscle power to generate a secondary forward activation force 200 that urges the firing unit 22 forwardly relative to the stabilized actuator 74 so that the trigger 24 collides a second time with the stabilized actuator 74. The stimulating step is then repeated with respect to the second round of ammunition in the receiver 21. The whole firing cycle described above can then be repeated for a third and following rounds in rapid succession, resulting in a unique and enjoyable shooting style where the user creates the forces 200, 204 that, acting in opposition to the recoil force 202, cause the firing unit 22 to shuttle quickly back-and-forth in the handle 20.

The method of this invention is distinguished from the relatively uncontrollable prior art techniques of bump firing and trigger activated techniques popularized by devices like the HELLSTORM 2000 and TAC Trigger in that the firing unit 22 is slideably supported for linear reciprocating movement relative to the stabilized actuator 74 during the moving and re-moving steps, such that the linear reciprocating movement occurs along a constrained linear path P that is generally parallel to the firearm barrel 23. Thus, the firing unit 22 is forced to reciprocate in a linear path P that is generally parallel to the barrel 23 which allows a user to maintain substantially better aim and control over the trajectory of bullets 76 fired from the firearm.

In the standard implementation of the subject shooting method, which may be modified to better suit handicapped users or other non-standard applications, the user's second body part (e.g., right hand) is maintained in continuous operative relationship with the handle 20 (e.g., by way of a firm grasp on the grip portion 52) during the moving and said re-moving steps. In other words, in the standard implementation common to most users, their second body part (e.g., right hand) firmly and continuously holds the handle 20 while their first body part (e.g., left hand) firmly and continuously holds the firing unit 22 (e.g., via the hand guard 72 under the barrel 23). And still further, in the standard implementation the actuator 74 is in fact the index finger of the hand that is holding fast to the grip portion 52, which index finger extends over the finger rest 70 so that the trigger 24 will intermittently collide with the finger in response to linear reciprocating movement of the firing unit 22. This so-called standard implementation is illustrated in FIGS. 10-11B. Non-standard implementations would include the substitution of other body parts for the left and/or right hands of the user, as may be preferred for handicapped shooters as well as practiced in various forms by non-handicapped shooters.

Turning again to FIG. 11B, the recoil force is indicated by the large directional arrow 202 lying along a vector parallel to the constrained linear path P. Preferably, but not necessarily, the user will reduce the primary forward activation force 202 while the recoil force 202 is being generated. With or without a force reduction, the user is encouraged to continue the application of a forwardly directed negative-resistance 204 human muscle power through the user's first body part to the firing unit 22 (e.g., left hand via the hand guard 72). In cases where there is a reduction in the primary forward activation force 202, that reduction is discontinued prior to the re-moving step (i.e., before the user generate a secondary forward activation force 200). The negative-resistance 204 typically will have a force value equal to or less than the recoil force 202, but greater than zero. (In some cases of very slow shooting tempos, it may be possible that the negative-resistance 204 can be greater than the immediately adjacent forward activation force 200, provided the negative-resistance 204 remains less than the recoil force 202.) The negative-resistance 204 acts in a direction opposite to the recoil force 202, so that if the negative-resistance 204 were equal to or greater than the recoil force 202 then the firing unit 22 would not travel rearwardly the distance D needed to reset the trigger 24.

The application of the negative-resistance 204 has several advantages. For one, it dampens the return travel of the firing unit 22 thereby having an incremental positive effect on the impact of components in the sliding interface 54 and bearing element 60. For another, it allows the user to maintain constant forward pressure through the first body part (e.g., left hand), selectively with varying or modulating force, which results in faster muscular reaction time as compared with motions that require direction reversals. Said another way, the user may perform this shooting method extending only one muscle group, or one set of muscle groups continuously (and optionally with modulating force). Exerting continuous extension of the muscle group controlling the user's first body part is a much faster muscular control exercise than trying to alternate two opposing muscle groups (e.g., biceps and triceps) between extension-relaxation modes, thus allowing the firearm to be repeat fired at a faster rate. A still further advantage is that the user can, if desired, change the firing rate tempo on the fly by varying either or both of the forward activation forces 200 or the negative-resistance 204. That is to say, a generally constant firing tempo will be achieved by maintaining a generally constant forward activation force 200 and negative-resistance 204. However, by modulating on-the-fly at least one of the forward activation force 200 and negative-resistance 204, the user can effect a controlled rate change in the number of rounds fired per minute.

Figure 12:
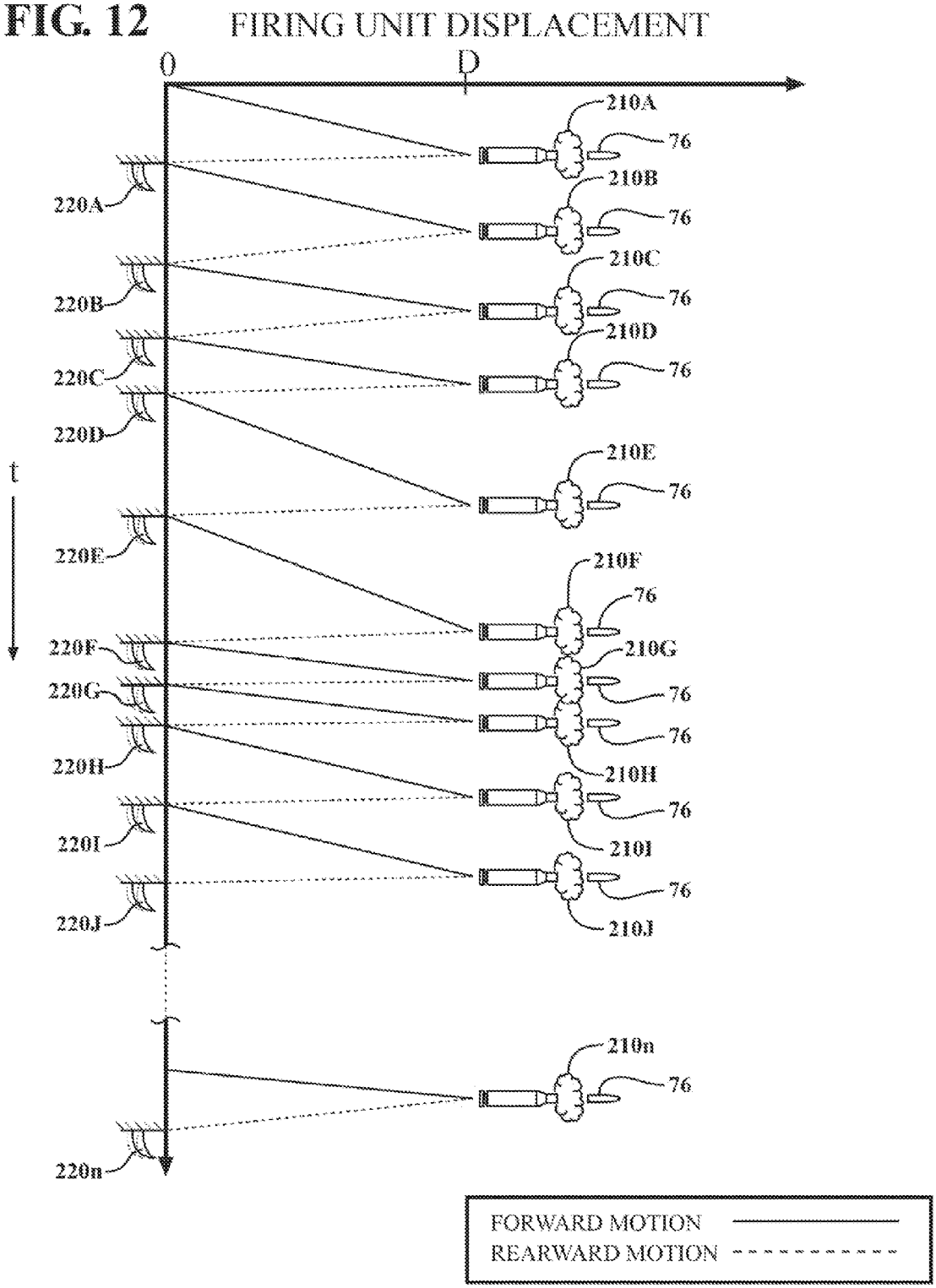
FIG. 12 is a simplified diagram charting displacement of the firing unit (relative to the handle) versus time to show the relationship between forward and rearward movement of the firing unit to trigger resetting and ammunition discharge, with the firing tempo being varied by changes in the user's muscle power.

With regard to this latter benefit, reference is made to FIG. 12 which represents a simplified time (t) chart showing the relationship between forward and rearward movement of the firing unit 22 in the handle 20. In this illustration, graphic depictions of each ammunition discharge event are identified by the number 210, with the discharge sequence indicated by the suffix letters A, B, C, . . . n. Thus, 210A identifies the first ammunition discharge event, 210B the second discharge event, 210C the third discharge event, and so on. The trigger resetting events are graphically depicted at 220, with the resetting sequence indicated by the suffix letters A, B, C, . . . n. Thus, 220A identifies the trigger resetting event immediately following the first ammunition discharge event 210A, 220B identifies the trigger resetting event immediately following the second ammunition discharge event 210B, and so on. The motion of the firing unit 22 relative to the handle 20 is shown by alternating solid and broken lines extending in sequential zigzag fashion between the discharge 210 and resetting 220 events, starting at 0,0 and working downwardly as viewed from FIG. 12. The solid lines here represent forward motion of the firing unit 22 (moving left to right as viewed from FIG. 12) accomplished by the user's muscle power in the form of the previously described forward activation forces 200. The broken lines here represent rearward motion of the firing unit 22 (moving right to left as viewed from FIG. 12) accomplished by the recoil force 202 as offset by user's muscle power in the form of the previously described negative resistance 204.

Careful attention to FIG. 12 will reveal that the firing rate or tempo between and among discharge events 210A-210D is substantially equal even though the time period between trigger resetting events 220A-220B is longer than the time period between trigger resetting events 220B-220C. This may at first seem counter-intuitive, but is in fact one indication enabled by the subject invention—that a user may maintain constant firing tempo by modulating, on-the-fly, their forward activation forces 200 relative to their negative resistance 204. And by extension, the user may also vary the tempo of the firing rate by modulating, on-the-fly, their forward activation forces 200 relative to their negative resistance 204. An example of varied firing rates may be seen by comparison of the time span between discharge events 210E-210F and 210F-210G. Thus, by proportionally increasing their forward activation forces 200 and/or decreasing the negative resistance 204, the firing rate of the firearm can be made faster. And conversely by proportionally decreasing their forward activation forces 200 and/or increasing the negative resistance 204, the firing rate of the firearm can be slowed. With subtle variations in muscle control, a user can change the burst speed of ammunition between exceptionally fast and essentially single shot conditions. With practice, a user can predetermine the number of rounds to be discharged in a particular burst, e.g., 3-round or 5-round bursts, and achieve that intent through the careful control of their muscles.

Figure 13:
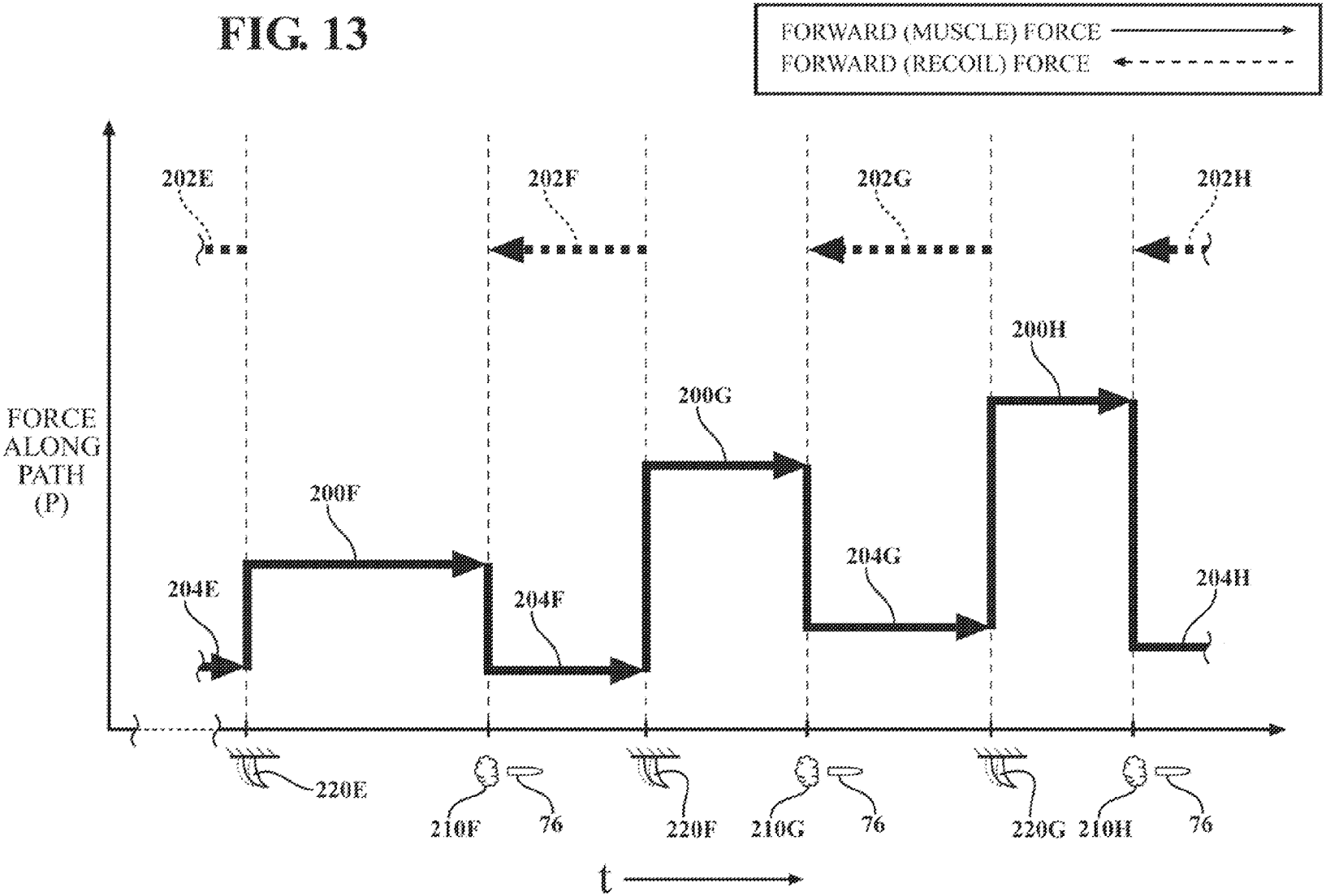
FIG. 13 is a simplified diagram charting force along the constrained linear path (P) versus time to illustrate the relationship between changes in forward muscle force and corresponding changes in the firing tempo of the firearm.
Figure 14:
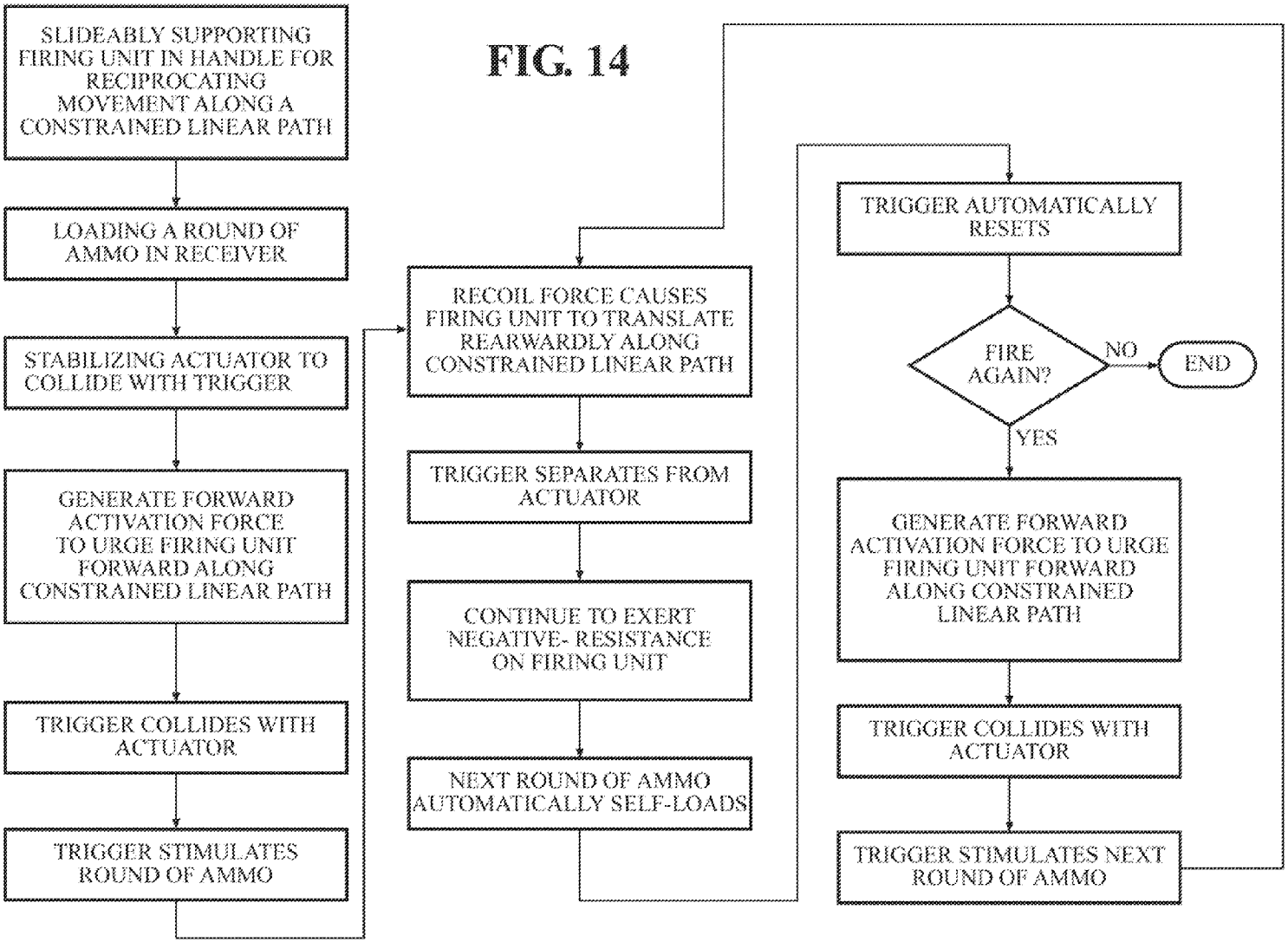
FIG. 14 is a simplified flow diagram illustrating steps in the firing method according to one embodiment of this invention.

FIG. 13 reinforces this phenomenon by illustrating, in simplified form, the various forces along the constrained linear path P versus time (t) for the resetting and discharge events from 220E-210H as per the FIG. 12 example above. The force along the constrained linear path P is a composition of forward activation forces 200, recoil forces 202, and negative-resistance 204. In comparing the forward activation force 200F immediately following trigger reset 220E to the forward activation force 200G immediately following trigger reset 220F, in can be observed that the greater force 200G results in a shorter time for the firing unit 22 to traverse the distance D (i.e., to move between trigger rest 220F and discharge event 210G). This follows naturally from the well-know equation: Force=mass*acceleration. Where the traveling distance D is fixed, an increase in force (on a firing unit 22 having constant mass) results in a corresponding increase in acceleration which is accompanied by a proportional decrease in travel time and vice versa. A similar observation can be appreciated by comparing the forward activation force 200G to Error! Not a valid link.200H. Conversely, however, greater force exerted by the user during the negative-resistance 204 phases results in a longer time for the firing unit 22 to traverse the distance D. Compare for example the time intervals between the lower negative-resistance 204F and the higher negative-resistance 204G. This is because the negative-resistance acts against the recoil force 202 and opposite to the traveling direction of the firing unit 22, thus causing the firing unit 22 to traverse the distance D more slowly. It will be noted that the recoil forces 202 are generally assumed to be equal when the same type and specification of ammunition is used to fire successive rounds.

Accordingly, FIG. 13 shows how changes in forward muscle force (200 and/or 202) will result in direct and corresponding changes to the firing tempo of the firearm. Rapid fire mode can be sustained for as long as the ammo supply lasts. Throughout an extended rapid-fire volley, the user will typically maintain forwardly directed muscle force on the firing unit 22, which forwardly directed force may modulate in intensity between highs and lows of the activation 200 and negative-resistance 204 phases. Or, the shooter may simply choose to maintain a generally constant forwardly directed force and not modulate between highs and lows, in which case the firing tempo will remain generally constant. When practicing this method, the shooter's arm (or other first body part) acts something like a spring, or perhaps like the leg muscles of a down-hill skier, constantly extending and absorbing the impact of recoil forces 202. Because the firing cycles occur so rapidly in comparison to human reaction times, the user will fall into a natural rhythm of shooting in rapid succession with a constantly applied forward muscle force that is comfortable, accurate, easy to learn, and infinitely variable in response to slight on-the-fly muscular changes willed by the shooter.

Furthermore, the user's forward activation forces 200 are always aligned in a vector parallel to the barrel 23, which means that during sustained firing of multiple rounds of ammunition in succession from a semi-automatic firearm, the user is continuously redirecting the barrel 23 (relative to the anchored second body part) in the aiming direction of the target. As a result, if the barrel 23 lifts under the recoil forces 204 characteristic with most if not all high-powered rifles, the user's muscular action (via the first body part) required to bring about the very next discharge event 210 will tend to pull the barrel 23 back in line with the intended target. One can imagine that in rapid fire mode, where discharges 210 may occur at rates of several rounds per second, every forward activation force 200 incrementally re-aligns the barrel 23 toward the object at which the shooter is aiming. Consequently, substantially more accurate, more controlled, and hence more safe shooting can occur in rapid fire mode using the principles of this invention.

Accordingly, in the rapid fire mode, human muscle effort is used to push the firing unit 22 forward while the handle 20 is held generally stationary against the shooter's body. In the standard implementation, the operator places a first body part (such as a left hand in the case of a right-handed shooter) on a hand guard 72 under the barrel 23, and another body part (such as the right hand of a right-handed shooter) on the grip 52 of the handle 20. The user presses the butt end 32 of the shoulder stock 26 tightly against their body (for example the right shoulder of a right-handed shooter). This standard grip is illustrated in FIGS. 10-11B in the context of a right-handed shooter. Of course, other configurations of the invention are conceivable in which a single hand (or other body part) is used to supply the human effort needed to both push the firing unit 22 forward while the handle 20 remains stationary relative to another body part. This may be accomplished by suitable push-rod or lever mechanisms, or other manually controlled constructions. In the case of a handicapped operator that does not have use of one or perhaps even both arms, the device may be configured to allow a operator to apply other forms of muscle effort, such as from a leg, neck, or torso. In these examples, leg, neck, or torso comprises the first body part. In all such cases, it is preferred that human muscle effort is the primary (if not exclusive) source of energy for moving the firing unit 22 forward against the recoil energy of a fired bullet 76. The act of holding the handle 20 stationary may, if desired, be accomplished by a fixed mounting arrangement such as by a shooting table or rest. The optional stationary mounting configuration may be preferred by disabled sportsmen, for example, as a convenience. Amputees, quadriplegics, and others that may be challenged to manipulate objects requiring the use of their fingers previously had limited options to assist them when operating a firing unit. The subject invention enables these individuals to operate the firing unit 22 without the need to manipulate small and delicate parts as was typical in prior art shooting systems. Thus, in cases where the handle 20 is held stationary by means of some fixed mounting arrangement, the user's first body part may comprise a hand, arm, leg or shoulder (for examples), and the second body part may comprise the portion of their body that is anchored relative to the handle 20, such as their torso in a chair.

Returning again to the most typical applications of this invention, the operator shoulders the firing unit 22 or otherwise positions the firing unit 22 to be fired at an intended target. At this stage, the firing unit 22 and handle 20 are manually compressed together so that the trigger 24 is recessed behind the finger rest 70. When the operator (i.e., the shooter) is ready to discharge a round, he or she firmly places a finger 74 in the scalloped portion of the finger rest 70 of the trigger guard 66. Any applicable safety switch is moved to a FIRE condition,. and then the operator applies human effort to push the hand guard 72 of the firing unit 22 longitudinally forward so as to move the firing unit 22 forward relative to the handle 20. Simultaneously with this action, the operator securely holds the handle 20 (or it is held in place by a suitable mount) so that it does not move together with the firing unit 22. All the while, the operator's finger 74 is held fast against the rest 70. The trigger guard 66 holds the finger 74 away from the trigger 24 until the firing unit 22 travels forwardly the predetermined distance D, at which point, the trigger 24 collides with the finger 74 in the finger rest 70, thereby activating the trigger 24 and discharging a bullet 76 from the firing unit 22. As explained above, a cross-pin or any other comparable object could be substituted for the finger 74 for activating the trigger 24. Since there is no movement of the operator's finger 74 during bump firing, the intentional forward movement of the firing unit 22 is considered responsible for triggering the fire control mechanism of the firing unit 22. In other words, the muscular application of force to create forward movement of the firing unit 22 defines the volitional act of the shooter to discharge each individual round of ammunition. Each discharge requires a separate volitional decision of the operator to exert his or her body strength to move the firing unit 22 back to a firing condition.

The discharge 210 of the bullet 76 creates a recoil 202 in the firing unit 22 that pushes the firing unit 22 longitudinally backward relative to the handle 20, thereby resetting the trigger 24. The firing unit 22 stops moving backward as soon as the recoil energy 202 subsides to the point at which it is counterbalanced by the human effort 204 that is urging the firing unit 22 forwardly, such as by a hand pushing the hand guard 72 forwardly. In any event, the firing unit 22 will stop moving backward if the bearing element 60 strikes the back 56 of the sliding interface 54 of the grip portion 52. Because the trigger 24 has been reset automatically during backward travel of the firing unit 22, the operator's muscle power 200 pushing the hand guard 72 of the firing unit 22 forwardly will bring the trigger 24 and finger 74 back into collision and cause the firing unit 22 to discharge another round of ammunition 210.

As can be predicted, in the rapid fire mode a fairly brisk rate of firing can be achieved by rhythmically applying forward forces 200, 204 on the hand guard 72 of the firing unit 22. However, the negative-resistance phase 204 of the forward force must not be so great as to overcome the recoil force 202 generated by expanding gases in the discharged bullet 76. For example, if a particular bullet 76 creates a recoil energy 202 of 15 lbf in the firing unit 22, then the negative resistance 204 applied to the hand guard 72 must be less than 15 lbf so that the firing unit 22 is able to move backward by the predetermined distance D and allow the trigger 24 to reset 220. if the operator applies a negative resistance 204 on the hand guard 72 greater than 15 lbf in this example, then the firing unit 22 will not slide rearwardly by any appreciable distance and the trigger 24 will not reset. In other words, the operator will have overpowered the recoil energy 202 from the discharge 210.

An experienced user of this invention thus will develop a new and interesting shooting form by which their human muscle effort applied to separate the firing unit 22 and handle 20 will be temporarily decreased substantially simultaneously with the recoil of the firing unit 22, thereby allowing the firing unit 22 to slide backward in the handle 20 so that the trigger 24 has a chance to reset. If the user decides to decrease their application of muscular force to zero or nearly zero during the recoil event, the firing unit 22 will slide rearwardly quite rapidly with the bearing element 60 arresting movement when it bottoms in the sliding interface 54. Naturally, this is not a recommended way to operate the firing unit 22 because the service life of the components may be reduced with hash impacts. Once the trigger 24 is reset, the user will then increase their muscle effort to separate the firing unit 22 and handle 20 and thereby rapidly return the firing unit to a firing condition.

In the preferred or recommended method of rapid firing according to the principles of this invention, the operator's application of muscular force 200, 204 to separate the firing unit 22 and handle 20 will fluctuate between a minimum value during the recoil event and a maximum value commencing as soon as the trigger 24 has moved the predetermined distance D. The minimum value will provide a degree of resistance to the recoiling firing unit 22 sufficient to arrest its rearward movement before the bearing element 60 bottoms in its sliding interface 54 but not so great as to prevent full resetting of the trigger 24. The maximum value must be large enough to return the firing unit 22 to a firing condition while maintaining full and graceful control of the firing unit 22. In this way, a rhythmic shooting style can be learned that adds a new enjoyment and excitement to the sport of shooting firing units, and which remains under uninterrupted control of human muscle power. In other words, if at any time during the rapid firing mode an operator does not apply sufficient effort to separate the firing unit 22 and handle 20, the firing unit 22 will immediately cease firing thus making the rapid firing mode of operation dependent on an actively engaged operator.

Because the shooter will intuitively learn to adjust the effort applied to separate the firing unit 22 and handle 20 in bump-fire mode, the type of ammunition used will not affect the functionally of the subject invention. As an example, it is well known that an three otherwise identical AR-15 style semi-automatic firing units 22 can be chambered for different calibers, such as 0.223, 7.62×39, 9 mm, etc. Each of these ammunition types will produce a substantially different amount of recoil energy. However, the same handle 20 of the subject invention can be fitted to all three of these firing units 22, without alteration, and operate flawlessly in bump-fire mode with the only change being slight variations in muscle effort applied by the shooter in response to the varying recoil energies produced by the three separate rounds of ammunition. The invention thus introduces an opportunity for new muscle control techniques in the shooting arts that can be fostered with practice so as to develop previously unknown skills and nuances. The novel shooting method of this invention, which includes manually moving the firing unit 22 forwardly relative to the handle 20 by the predetermined distance D, has the potential to invigorate the shooting sports with new interest, competitions, discussion forums and fun.

FIG. 8 shows a side view of the, trigger guard 66 and the trigger 24 while the firing unit 22 is operated in the rapid fire mode. The solid lines show the trigger 24 in a first position after the recoil has pushed the firing unit 22 longitudinally backward to the point where the bearing element 60 has struck the back 56 of the sliding interface 54. The dashed lines show the trigger 24 in a second position after the firing unit 22 has been pushed longitudinally forward relative to the handle 20 by the predetermined distance D to collide the trigger 24 with the operator's finger 74. In other words, the predetermined distance D is the distance that the trigger 24 moves from the first position to the second position. It should be appreciated that the bearing element 60 and buffer tube 30 also move longitudinally forward and backward relative to the handle 20 by the predetermined distance D when the firing unit 22 is fired in the rapid fire mode. It should be understood that in rapid fire mode, the shooter's own application of longitudinally forward movement is primarily, if not solely, responsible for activating the firing mechanism. The operator's finger 74, or other stationary object, performs no volitional action during rapid firing but rather acts as a dumb link in the firing cycle. In other words, a person with a paralyzed trigger finger 74 is able to rapid fire a firing unit 22 according to this invention with equal effectiveness as would a shooter having normal dexterity in their trigger finger 74. This is because the operator's trigger finger 74 does not squeeze the trigger 24 during the rapid firing mode; it is merely held firmly against the rest 70.

To switch to the standard fire mode, the operator simply changes the lock 44 from the open position to the locked position. The operator may now place the butt end 32 of the shoulder stock 26 firmly against his or her shoulder. The trigger 24 is accessible on the side opposite the trigger guard 66. Because the handle 20 and firing unit 22 are locked together by the lock 44, the trigger 24 cannot travel longitudinally forward to collide with the operator's finger 74. The operator's finger 74 must be placed directly on the trigger 24, and a longitudinally backward pressure must be applied on the trigger 24 to discharge the firing unit 24.

Figure 9:
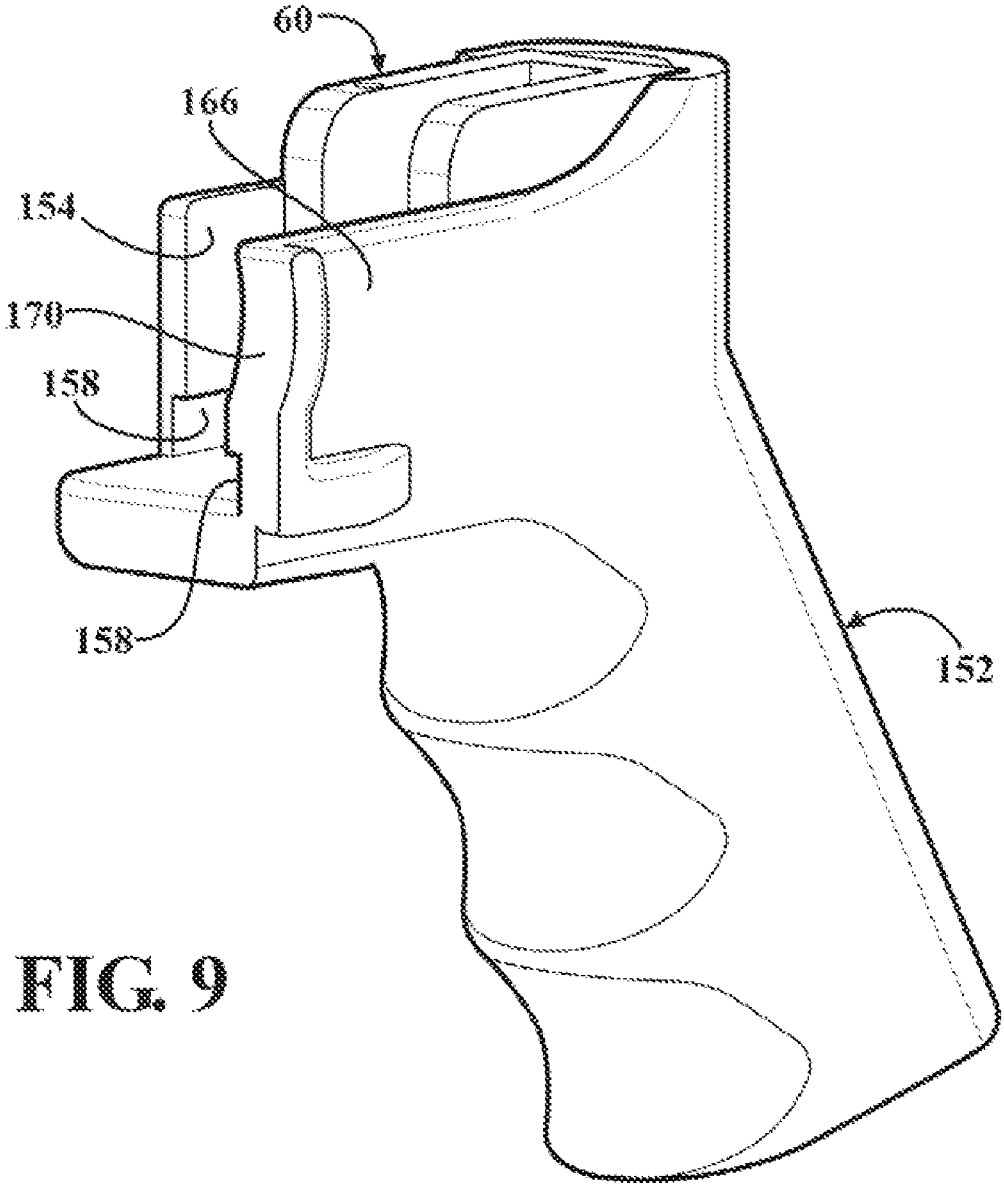
FIG. 9 is a perspective view of an alternative embodiment of the handle adapted for use with a pistol-style firing unit (as distinguished from a rifle-style firing unit)

FIG. 9 shows a second embodiment of the handle 120 for use with a semi-automatic hand gun. The second embodiment lacks the stock portion 126 of the first embodiment but includes a grip portion 152 defining a channel 154, a bearing element 60 slidably disposed in the channel 154, and a trigger guard 166 for predisposition in longitudinally forward of the trigger 124 of the hand gun. Similar to the first embodiment, the channel 154 of the second embodiment includes grooves 158 for receiving the ridges (not shown) in the bearing element 60. the trigger guard 166 also includes a finger rest 170 for holding a finger in a generally stationary position. The second embodiment may also include a lock so that it can function in either a rapid fire mode or a standard fire mode.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| D | predetermined distance |
| P | constrained linear path |
| 20 | handle |
| 21 | receiver |
| 22 | firing unit |
| 23 | barrel |
| 24 | trigger |
| 26 | stock portion |
| 28 | buffer cavity |
| 30 | buffer tube |
| 32 | butt end |
| 34 | ribs and webs |
| 36 | sling attachment point |
| 38 | undersurface |
| 40 | recessed portion |
| 42 | bore |
| 44 | lock |
| 46 | cam |
| 48 | pin |
| 50 | spring |
| 51 | detent |
| 52 | grip portion |
| 54 | Sliding interface |
| 56 | closed back |
| 58 | grooves |
| 60 | Bearing element |
| 62 | ridges |
| 64 | aperture |
| 66 | trigger guard |
| 70 | finger rest |
| 72 | hand guard |
| 74 | Actuator/finger |
| 76 | bullet |
| 200 | forward activation force |
| 202 | Recoil force |
| 204 | Negative-resistance |
| 210 | Discharge event |
| 220 | Trigger reset event |

What is claimed is:

1. A method for firing multiple rounds of ammunition in rapid succession from a semi-automatic firearm, said method comprising the steps of:

loading a first round of ammunition into the receiver of a semi-automatic firearm, the receiver configured for chambering a round of ammunition and operatively connected to a barrel extending forwardly from the receiver and a trigger configured to selectively stimulate a round of ammunition disposed in the receiver, the receiver and barrel and trigger being moveable together as a firing unit;

providing a handle adapted to be held by a user;

supporting the firing unit in a forward pointing direction by the handle so as to enable reciprocating movement between the handle and the firing unit;

stabilizing an actuator in a stationary position relative to the handle so that the firearm trigger will intermittently collide with the actuator in response to reciprocating movement of the firing unit;

generating a primary forward activation force without spring force assistance urging the firing unit forwardly while the user firmly holds the handle so that the trigger collides a first time with the stabilized actuator;

generating a recoil force sufficient to cause the firing unit to translate rearwardly relative to the stabilized actuator, separating the trigger from the actuator in direct response to the recoil force;

automatically self-loading a second round of ammunition into the receiver in response to the recoil force;

generating a secondary forward activation force without spring force assistance urging the firing unit forwardly relative to the stabilized actuator so that the trigger collides a second time with the stabilized actuator; and manually varying the intensity of the secondary forward activation force relative to the primary forward activation force to proportionally alter the firing tempo of the semi-automatic firearm.

2. The method of claim 1, further including reducing the primary forward activation force during said step of generating a recoil force with respect to the first round of ammunition, and further including reducing the secondary forward activation force during said step of generating a recoil force with respect to the second round of ammunition, and further including varying the intensity of said step of reducing the primary forward activation force with respect to the intensity of said step of reducing the secondary forward activation to proportionally alter the firing tempo of the semi-automatic firearm.

3. The method of claim 2, wherein said step of reducing the primary forward activation force includes applying forwardly directed negative-resistance human muscle power to the firing unit, the negative resistance having a force value less than the recoil force.

4. The method of claim 1, wherein the actuator comprises a human finger.

5. The method of claim 1, further including automatically resetting the trigger during said step of generating a recoil force.

6. The method of claim 1, further including automatically unloading any residual portion of the first ammunition from the receiver prior to said step of automatically self-loading a second round of ammunition into the receiver.

7. The method of claim 6, wherein said unloading and self-loading steps are carried out in response to gas pressure generated during said discharging step.

8. The method of claim 1, wherein said step of supporting the firing unit further includes slideably supporting the firing unit in the handle, and restricting access of the actuator to the trigger during said step of separating the trigger from the actuator.

9. The method as set forth in claim 8, wherein said step of restricting access includes substantially completely covering one side of the trigger with a guard during at least a portion of said step of generating a primary forward activation force.

10. The method as set forth in claim 9, wherein the actuator comprises a human finger having a tip and the guard includes a finger rest, further including placing the finger tip on the finger rest.

11. A method for firing multiple rounds of ammunition in succession from a semi-automatic firearm, the semi-automatic firearm of the type including a receiver configured for chambering a round of ammunition and operatively connected to a barrel extending forwardly from the receiver and a trigger configured to selectively stimulate a round of ammunition disposed in the receiver, the receiver and barrel and trigger being moveable together as a firing unit, said method comprising the steps of:

supporting the firing unit in a handle for reciprocating movement between the handle and the firing unit;

placing a first hand of a user in operative relationship with the firing unit;

firmly holding the handle with a second hand of the user;

stabilizing an actuator in a stationary position relative to the handle so that the firearm trigger will intermittently collide with the actuator in response to reciprocating movement of the firing unit relative to the handle;

moving the user's first hand to generate a primary forward activation force urging the firing unit forwardly relative to the handle without spring force assistance so that the trigger collides a first time with the stabilized actuator;

generating a recoil force sufficient to cause the firing unit to translate rearwardly relative to the handle held firmly by the second hand of the user, separating the trigger from the actuator in direct response to the recoil force;

during said step of generating a recoil force, applying forwardly directed negative-resistance human muscle power to the rearwardly translating firing unit through the user's first hand, the negative resistance having a force value less than the recoil force;

automatically self-loading a second round of ammunition into the receiver in response to the recoil force;

moving again the user's first hand to generate a secondary forward activation force urging the firing unit forwardly relative to the handle without spring force assistance so that the trigger collides a second time with the stabilized actuator.

12. The method of claim 11, wherein the actuator comprises a human finger.

13. The method of claim 11, further including automatically resetting the trigger during said step of generating a recoil force.

14. The method of claim 11, further including automatically unloading any residual portion of the first ammunition from the receiver prior to said step of automatically self-loading a second round of ammunition into the receiver.

15. The method of claim 14, wherein said unloading and self-loading steps are carried out in response to gas pressure generated during said discharging step.

16. The method of claim 11, wherein said step of separating the trigger from the actuator includes moving the trigger by at least a predetermined distance (D), and said step of supporting the firing unit further includes slideably supporting the firing unit in a forward pointing direction in a handle, and restricting access of the actuator to the trigger during said moving and said moving again steps until the firing unit moves forward relative to the handle by at least the predetermined distance (D).

17. The method as set forth in claim 16, wherein said step of restricting access includes substantially completely covering one side of the trigger with a guard during at least a portion of said step of moving the user's first hand to generate a primary forward activation force.

18. The method as set forth in claim 16, wherein the actuator comprises a human finger having a tip, further including placing the finger tip on the opposite side of the trigger from the guard and resting the finger tip on the finger rest and activating the trigger with the finger in response to the firing unit moving the predetermined distance (D) relative to the handle.

19. A method for firing multiple rounds of ammunition in succession from a semi-automatic firearm, the semi-automatic firearm of the type including a receiver configured for chambering a round of ammunition and operatively connected to a barrel extending forwardly from the receiver and a trigger configured to selectively stimulate a round of ammunition disposed in the receiver, the receiver and barrel and trigger being moveable together as a firing unit, said method comprising the steps of:

supporting the firing unit in a handle for reciprocating movement between the handle and the firing unit;

placing a first hand of a user under the barrel of the firing unit so as to move the firing unit in concert with movement of the first hand and vice versa;

gripping the handle with a second hand of the user, and holding the handle tight with respect to the body of the user;

stabilizing a trigger finger on the second hand of the user in a stationary position relative to the handle so that the firearm trigger will intermittently collide with the trigger finger in response to reciprocating movement of the firing unit;

moving the user's first hand without spring force assistance to generate a primary forward activation force urging the firing unit forwardly in the handle so that the trigger collides a first time with the stabilized trigger finger while the second hand holds the handle tight with respect to the body of the user.

* * * * *